United States Patent [19]

Dolan

[11] 4,253,008

[45] Feb. 24, 1981

[54] FUSING APPARATUS

[75] Inventor: Donald T. Dolan, Ridgefield, Conn.

[73] Assignee: Pitney Bowes Inc., Stamford, Conn.

[21] Appl. No.: 48,214

[22] Filed: Jun. 13, 1979

[51] Int. Cl.[3] ..... H05B 1/00

[52] U.S. Cl. ..... 219/216; 355/3 FU; 432/60

[58] Field of Search ..... 355/3 R, 3 FU, 3 SH, 355/14 FU; 219/216; 432/60, 228

[56] References Cited

U.S. PATENT DOCUMENTS

| | | | |
|---|---|---|---|
| 3,685,898 | 8/1972 | Gonzalez | 432/60 X |
| 3,893,800 | 7/1975 | Wako | 432/60 |
| 3,976,370 | 8/1976 | Goel et al. | 355/3 TR |
| 3,981,498 | 9/1976 | Fletcher | 355/3 R X |
| 4,125,362 | 11/1978 | Matsui et al. | 432/60 |

*Primary Examiner*—Fred L. Braun

*Attorney, Agent, or Firm*—Melvin J. Scolnick; William D. Soltow, Jr.; Albert W. Scribner

[57] ABSTRACT

A fusing apparatus comprises a heated roll fuser member; an endless belt which engages a portion of the peripheral surface of the heated roll fuser member to form an area through which substrates carrying toner images thereon move; first charging apparatus for applying an electrostatic charge to the belt opposite in polarity to the charge on the toner particles, the charging apparatus being positioned adjacent the belt so as to charge the portion of the belt supporting the substrate prior to it passing between the heated fuser roll and the belt; and second charging apparatus for applying an electrostatic charge on the fuser roll.

12 Claims, 2 Drawing Figures

FUSING APPARATUS

BACKGROUND OF THE DISCLOSURE

1. Field of the Invention

This invention relates to a fusing apparatus as is commonly used in xerographic copying machines, and more particularly to a fusing apparatus including a heated roll fuser member in pressure contact with an endless belt so as to form an area through which a substrate carrying a toner image thereon can pass to fuse the toner image to the substrate.

2. Description of the Prior Art

In a typical xerographic process a photoconductor comprising a photoconductive composition coated on a rigid or flexible substrate is uniformly electrostatically charged in the dark and then exposed by being illuminated in an image pattern in accordance with graphic material on an original document. The photoconductor becomes discharged in the areas exposed to the illumination, but retains its electrostatic charge in the dark areas, which areas correspond to the graphic material on the original document. The resulting electrostatic latent image is developed by depositing on the photoconductor a finely divided electrostatically attractable developing material (toner). The toner will normally be attracted to those areas on the photoconductor which retain a charge, thereby forming a toner image corresponding to the electrostatic latent image. This visible image of developing material is then transferred to a support surface, such as plain paper or any other suitable substrate, to become the ultimate copy. Any residual developing material remaining on the photoconductor is cleaned and the photoconductor is reused as described above for subsequent copies. The toner image that was transferred to the plain paper is then fixed thereto. Since the developing material is heat fusible, application of sufficient heat to the paper causes the developing material to melt and be fused into the paper so as to be permanently affixed thereto.

One basic and advantageous approach to fusing in a xerographic copying machine is the use of the so-called hot roll pressure fusing apparatus in which toner particles are melted by being in the direct contact, under pressure, with a hot surface of a heated fuser roll. However, this type of apparatus does present certain problems. For example, as the toner particles are heated they soften and become sticky to the extent that they can readily adhere to other surfaces. During a typical fusing operation there is a tendency for part of the heated image to stick to the heated fuser roll. The toner which adheres to the fuser roll will, of course, transfer to the next sheet of support material passing through the fuser, thus producing dirty copies. This process is commonly referred to in the printing art as "offset".

In an attempt to avoid the problem of offset, heated fusing rolls were developed which use either (1) a thin outer layer of a tetrafluoroethylene resin (e.g. a tetrafluoroethylene resin sold under the trademark "Teflon" by E. I. DuPont de Nemours & Co.) and a silicone oil film on the resin, or (2) a thin outer layer of a silicone elastomeric material (silicone rubber) and a silicone oil film on the elastomeric material. The physical characteristics of the Teflon material or the silicone rubber with the silicone oil film are such that they are repellent to sticky or tacky substances. Although the use of either of the above-described coated heated fuser rolls or many other different types of coatings used to prevent offset have helped to prevent this problem, they have not completely solved it.

SUMMARY OF THE INVENTION

It is therefore an object of the present invention to overcome the offset problems typically encountered in a hot roll pressure fusing apparatus by providing a fuser apparatus which employs a series of a corona devices to help prevent offset.

It is a further object of the present invention to provide a fuser apparatus that is relatively simple and inexpensive to manufacture as compared to many typical prior art devices.

It is still a further object of the present invention to provide a hot roll fuser apparatus that in addition to the above advantages provides for a simple means for adjusting the length of the fusing zone.

The foregoing objects and others are accomplished in accordance with the present invention by providing a fusing apparatus comprising a heated roll fuser member; an endless belt engaging a portion of the peripheral surface of the heated roll fuser member to form an area through which substrates carrying toner images thereon move; first charging means for applying an electrostatic charge to the belt opposite in polarity to the charge on the toner particles, the charging means being positioned adjacent the belt to apply the charge to the portion of the belt supporting the substrate prior to it passing between the heated fuser roll and the belt; and second charging means for applying an electrostatic charge on the fuser roll.

BRIEF DESCRIPTION OF THE DRAWINGS

For a better understanding of the invention as well as other objects and further features thereof, reference is made to the following detailed disclosure of this invention taken in conjunction with the accompanying drawings wherein.

DESCRIPTION OF THE PREFERRED EMBODIMENT

Figure 1:
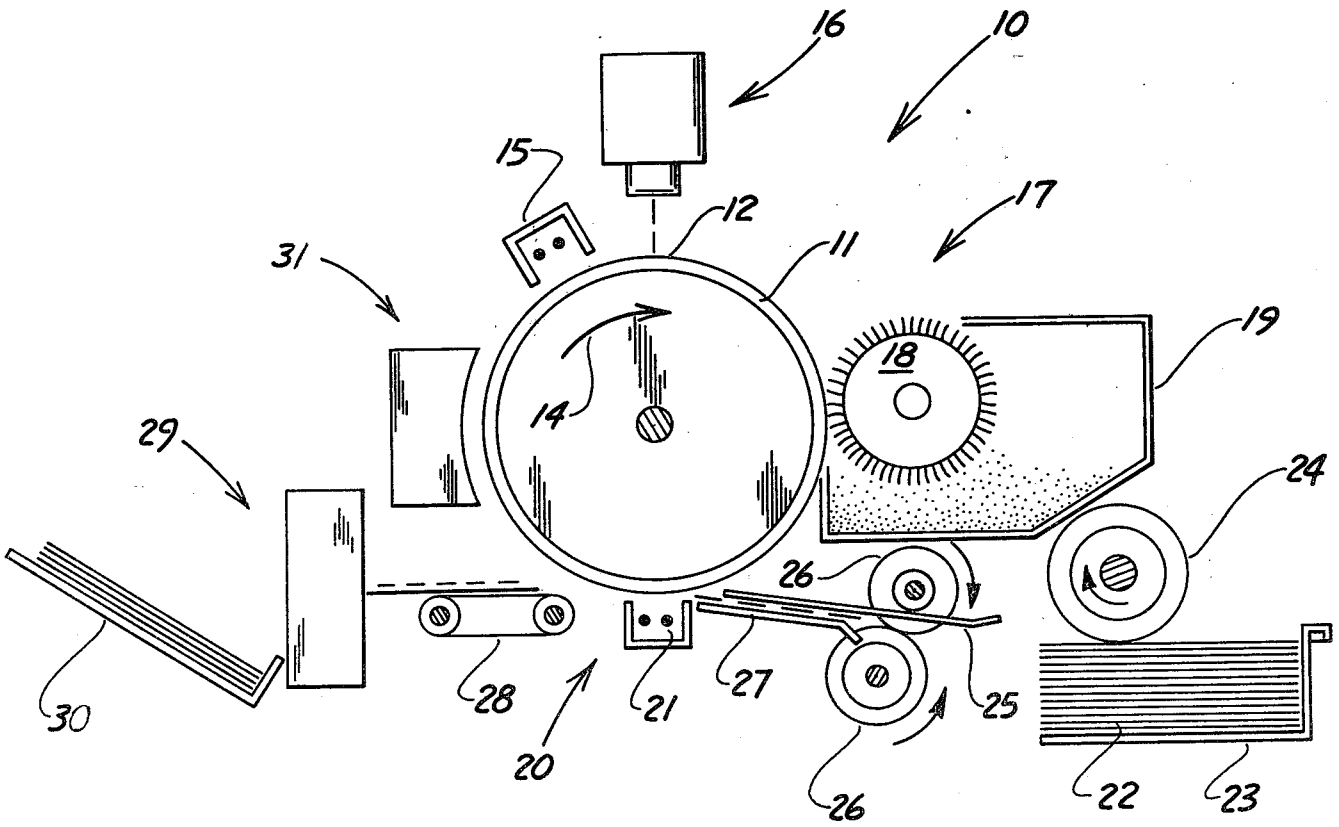
FIG. 1 is a schematic sectional view of a copier.

Referring now to the drawings and particularly to FIG. 1, there is shown an electrophotographic copying machine which can employ a fusing apparatus in accordance with the present invention. The various processing stations shown in FIG. 1 will be represented in part as blocks and these processing stations will only be briefly described. The particular copying machine illustrated in FIG. 1 is merely exemplary as far as the present invention is concerned for a complete understanding of a xerographic process and, in particular, how a fusing apparatus is employed in such a process. A fusing apparatus in accordance with the present invention may be utilized in a wide variety of devices including coated paper copiers and plain paper copiers, and is not necessarily limited to the particular type of copier system shown in FIG. 1.

In FIG. 1, the reference numeral 10 generally designates an electrophotographic copying machine which includes a rotating drum 11 having a photoconductive surface 12 secured around the outer surface of the drum. Any of numerous inorganic or organic photoconductive materials can be employed such as for example, a selenium alloy. Additionally, the photoconductor can be in the form of a belt instead of a drum. As drum 11 rotates in the direction of arrow 14, it passes through the various processing stations disposed around the periphery of the drum.

First, drum 11 rotates a portion of photoconductive surface 12 through a charging apparatus which includes a corona generating device 15 that is positioned closely adjacent the surface of the photoconductor. Corona generating device 15 imparts a uniform electrostatic charge to photoconductor surface 12.

An image of the document to be copied is transmitted to photoconductor surface 12 by the exposure and imaging station generally designated 16. This station could, for example, include a reciprocating carriage that is movably mounted on top of the copying machine cabinet. The carriage would include a transparent platen on which documents are placed faced down for copying. Overlying the platen would be a movable cover connected to one side of the carriage. An operator can raise and lower the cover and thereby place on or remove documents from the platen. A series of lamps would be used to illuminate the original document. By incorporating an optical system comprising mirrors and lenses a light image of the original document to be copied is projected onto the charged portion of photoconductive surface 12. The movement of the carriage and therefore the scanning of the original document is in timed relationship with the movement of rotating drum 11. Thus photoconductive surface 12 is selectively exposed to dissipate the charge thereon and record an electrostatic latent image corresponding to the indicia on the original document.

As drum 11 rotates, the latent image on photoconductive surface 12 is carried past a developer station 17. The developer material used can, for example, be a two component developer which comprises carrier particles having toner particles adhering thereto. The carrier particles are formed of a magnetic material while the toner particles are usually a heat settable plastic. However, a single component toner can also be used. Preferably a magnetic brush developing unit is used in which a rotating magnetic roll 18 picks up toner from a hopper 19 to form a rotating magnetic brush, and carries that toner into contact with the latent image on photoconductive surface 12. The charged or latent image areas of the photoreceptor electrostatically attracts and holds the toner particles, thus developing the latent image.

Transfer station 20 includes a corona transfer charging apparatus 21. In timed relationship with the arrival of the developed image at transfer corona 21, a copy sheet also arrives at transfer station 20. The copy sheet is fed from a supply of sheets 22 stored in removable tray 23. A feed roller 24 feeds the uppermost copy sheet from the supply 22, through paper guide 25 and into the nip of queuing rollers 26. At a predetermined time in the course of a copy cycle, the queuing rollers 26 are actuated to feed the copy sheet along paper guide 27 and into contact with the developed image carried on photoreceptor surface 12. By virtue of the electric charge that is generated by transfer corona 21, toner particles are attracted from photoreceptor surface 12 toward the copy sheet to which they loosely adhere. After transferring the toner powder to the copy sheet, the sheet is stripped away from drum 11 by a suitable apparatus, and advanced by belt conveyor 28 to fixing station generally designated 29.

Figure 2:
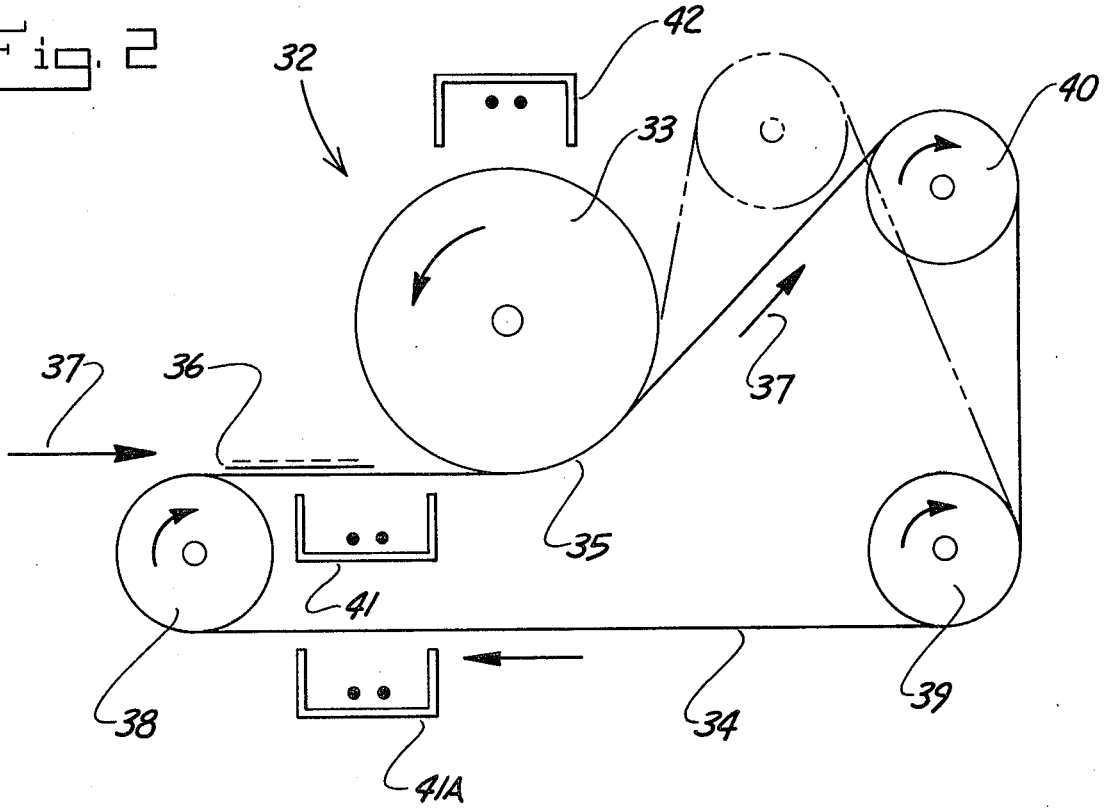
FIG. 2 is a schematic sectional view of a fusing apparatus in accordance with the present invention.

The copy sheet then passes into fixing station 29 which includes a fusing apparatus in which the toner material now residing on the copy paper is heated to a temperature at which the toner particles melt and are thereby fused into the copy paper so as to form a permanent copy of the original document. In accordance with the present invention a fusing apparatus as shown in FIG. 2 and as more fully described hereinbelow can be used. After the toner image is permanently affixed to the copy sheet, the sheet is advanced to a catch tray 30 for subsequent removal from the copier by an operator.

In order to remove residual toner particles which adhere to photoconductive surface 12 after the transfer of the powder image to the copy sheet, copying machine 10 is provided with a cleaning system generally designated by reference number 31. The cleaning mechanism can, for example, include a corona generating device and a brush which contacts photoconductive surface 12. First, the remaining toner particles are brought under the influence of the corona generating device to neutralize the electrostatic charge remaining on photoconductive surface 12 and that of the residual toner particles. Thereafter, the neutralized particles are removed from surface 12 by the rotatably mounted brush. After the cleaning operation, a discharge lamp can be used to discharge remaining charges on surface 12 prior to the recharging thereof at corona device 15 for the next copying cycle.

Referring now to the specific subject matter of the present invention, there is illustrated in FIG. 2 a preferred embodiment of a fuser apparatus in accordance with the features of the present invention. Specifically there is shown a fusing apparatus 32 including in combination of a heated roll fuser member 33 and an endless belt 34 made, for example, of a heat-resistant material having a low thermal conductivity (e.g. silicone rubber) which engages a portion of the peripheral surface of fuser member 33 to form an area 35 (fusing zone) through which a substrate 36, such as a sheet of paper, carrying a toner image thereon moves to fuse the toner image to the substrate. Endless belt 34 moves in the direction of arrows 37 and is supported and driven by rollers 38, 39 and 40 and a drive system (not shown).

Any heated roll fuser capable of generating sufficient heat to fuse toner particles to a substrate can be used as heated roll fuser member 33 in fusing apparatus 32. For example, fuser member 33 can be structured similar to any of the fuser rolls well-known in the art, including those rolls having either a thin outer layer of a tetrafluoroethylene resin, e.g. Teflon or a thin layer of a silicone elastomeric material, e.g. silicone rubber. The fuser can be internally heated with a radiant heater, such as an infrared lamp or a halogen lamp, centrally located within the fuser roll and have a suitable temperature control means, e.g. a thermostat for being able to control the surface temperature of the fuser roll. In accordance with a preferred embodiment of the present invention a heated roll fuser 33 can be heated by heating elements made of certain semiconducting ceramic materials. Details of the ceramic materials which could be used as heating elements for fusers can be found in commonly assigned and copending U.S. patent application Ser. No. 041,024, filed May 21, 1979 and entitled "Temperature-Self Regualating Fuser". Preferred structures for a heated fuser member 33 which contain these ceramic heating elements are disclosed in commonly assigned and copending U.S. patent application Ser. Nos. 041,025 and 041,026, both filed on May 21, 1979 and entitled "Hot Roll Fusing Devices". Both of these applications describe structures for heated fuser rolls which include heating elements formed of a semiconducting ceramic material having a positive temperature coefficient of resistivity and exhibiting a Curie temperature transition point at which the resistance of the material increases with increasing temperature. The preferred semiconducting ceramic materials for these heating elements have a Curie temperature or transition temperature such that when the material reaches its particular Curie temperature the resistance of these materials increases by several powers of ten. These materials, when employed in a fuser roll as heating elements impart to the fuser roll the ability to operate as a self-regulating heat source. At a given voltage the heating elements draw a high current. This is because the elements are cold and their resistance is low. Within a few seconds the Curie temperature of the ceramic material is reached, there is a sharp increase in resistance, e.g. from 50 ohms to 5,000 ohms, and an immediate restriction in the amount of power absorbed. Thereafter a state of equilibrium arises in which the power absorbed adjusts itself such that it is equal to the heat dissipated. Thus, the material tends to keep its temperature substantially in the vicinity of the Curie temperature. The particular ceramic material composition chosen for use as the heating element, of course, depends upon the fusing temperature requirements. Ceramic semiconducting materials that exhibit Curie temperature within the range of about 150° C. to about 220° C. are the preferred materials for use as heating elements. Compositions comprising barium titanate with strontium titanate and/or lead titanate, and a small amount of lanthanum in the form of lanthanum titanate, e.g. 0.3 mol %, (lanthanum is added in sufficient amount to impart semiconductive properties to the material) are particularly well suited as compositions for these heating elements.

An additional advantage of fusing apparatus 32 as illustrated in FIG. 2 is that there is provided a simple mechanism for adjusting the fusing time, i.e. the time for which the toner particles on substrate 36 are subject to the fusing temperatures of fuser roll 33, by increasing the length of fusing zone 35. This is accomplished by providing means (not shown) for moving roller 40, and thereby allowing it to be displaced from its position as illustrated in FIG. 2. For example, roller 40 can be displaced to the position indicated by the dotted lines so that the length of endless belt 34 which contacts the peripheral surface of fuser roll 33 is increased. This feature of the present invention avoids the necessity of heating fusing roll 33 to extremely high temperatures because of short fusing times. Thus, deterioration of the fuser roll due to high heating temperatures is avoided.

A first corona generating device indicated as 41 and extending longitudinally in a transverse direction across the bottom surface of endless belt 34 is used to place a electrostatic charge on the belt opposite in polarity to whatever charge is on the toner particles found on the surface of substrate 36. Since the toner particles will tend to stick onto fuser roll 33, i.e. offset, it is the purpose of corona device 41 to place a charge on the belt opposite to the charge on the toner particles prior to fusing to electrostatically adhere the particles to substrate 36 and help prevent the particles from transferring onto fuser roll 33. To accomplish this result corona device 41 is a D.C. corona which can place a potential on the bottom surface of belt 34 that can be positive or negative D.C. depending on the charge on the toner particles. The use of corona device 41 to help prevent offset is employed in addition to whatever means is used for this purpose in the form of coatings on fuser roll 33. The effects of corona device 41 can be enhanced, if necessary, by using a second corona generating device indicated as 41A extending longitudinally in a transverse direction across the upper surface of the endless belt 34 to place an electrostatic charge on the upper surface of the belt, opposite in polarity to whatever charge is on the toner particles. Like device 41, corona device 41A is a D.C. corona which can place a potential on the upper surface of belt 34 that can be positive or negative D.C. depending on the charge on the toner particles.

In the majority of situations the use of corona devices 41 and/or 41A to help prevent offset should be sufficient. However, in one preferred embodiment of the present invention, the effect of corona devices 41 and/or 41A can be enhanced by employing a corona generating device indicated as 42 at fuser roll 33 as shown in FIG. 2. Corona device 42 extends longitudinally in a transverse direction across the peripheral surface of fuser roll 33, and serves to place an electrostatic charge on fuser roll 33 having the same polarity as that of the toner particles on substrate 36. In this embodiment, corona device 42 functions to place a charge on fuser roll 32 having the same polarity as that of the charge on the toner particles on substrate 36 to prevent any particles from adhering to the fuser roll surface by repelling them from the fuser roll surface. For this purpose corona device 42 is a D.C. corona which can place a potential on the fuser roll that can be positive or negative D.C. depending on the charge on the toner particles.

In an alternate embodiment of the present invention it would be desirable to remove all electrostatic charges that would tend to migrate to fuser roll 33 during operation of fusing apparatus 32 and thus render the fuser roll neutral. This would prevent any charges which accumulate on the fuser roll from interferring with the movement of substrate 36 as it travels through the fusing apparatus. In this embodiment corona device 42 would be an A.C. corotron functioning to neutralize any charge pattern on the fuser roll.

While this invention has been described in conjunction with a specific embodiment thereof, it is evident that many alternatives, modifications and variations will be apparent to those skilled in the art. Accordingly, the present invention is intended to embrace all such alternatives, modifications and variations and fall within the spirit and scope of the appended claims.

I claim:

1. A fuser apparatus comprising:

a heated roll fuser member;

an endless belt engaging a portion of the peripheral surface of said heated roll fuser member to form an area through which substrates carrying toner images thereon move; and electrostatic means for preventing toner particles from transferring onto said fuser roll including, first charging means for applying an electrostatic charge to said belt opposite in polarity to the charge on the toner particles, the charging means being positioned adjacent said belt to apply said charge to the portion of said belt supporting said substrate prior to it passing between said heated roll fuser and said belt; and second charging means for applying an electrostatic charge on said fuser roll.

2. A fuser apparatus according to claim 1 wherein said first charging means is a D.C. corona device.

3. A fusing apparatus according to claim 1 wherein said second charging means is a D.C. corona device for applying a charge on said fuser roll having the same polarity as the charge on said toner particles.

4. A fusing apparatus according to claim 1 wherein said second charging means is an A.C. corona device for applying a charge on said fuser roll sufficient to neutralize any charge on the roll.

5. A fusing apparatus according to claim 1 further comprising a series of rollers upon which said endless belt is mounted, at least one of said rollers being movably mounted such that the size of the area of contact between said peripheral surface of the heated roll fuser and said belt is adjustable.

6. A fuser apparatus according to claim 1 wherein said belt is made of a flexible heat-resistant material having a low thermal conductivity.

7. A fuser apparatus according to claim 6 wherein said belt is made of silicone rubber.

8. A fuser apparatus comprising:

a heated roll fuser member;

an endless belt engaging a portion of the peripheral surface of said heated roll fuser member to form an area through which substrates carrying toner images thereon move; and electrostatic means for preventing toner particles from transferring onto said fuser roll including, a D.C. corona device for applying an electrostatic charge to said belt opposite in polarity to the charge on the toner particles, said device being positioned adjacent said belt to apply said charge to the portion of said belt supporting said substrate prior to it passing between said heated roll fuser and said belt; and an A.C. corona device positioned adjacent said heated roll fuser for neutralizing any charges on the roll fuser.

9. A fuser apparatus comprising:

a heated roll fuser member;

an endless belt engaging a portion of the peripheral surface of said heated roll fuser member to form an area through which substrates carrying toner images thereon move; and electrostatic means for preventing toner particles from transferring onto said fuser roll including, first charging means for applying an electrostatic charge to the bottom surface of said belt opposite in polarity to the charge on the toner particles; second charging means for applying an electrostatic charge to the upper surface of said belt opposite in polarity to the charge on the toner particles; and third charging means for applying an electrostatic charge on said fuser roll.

10. A fuser apparatus according to claim 9 wherein said first and second charging means are D.C. corona devices.

11. A fusing apparatus according to claim 9 wherein said third charging means is a D.C. corona device for applying a charge on said fuser roll having the same polarity as the charge on said toner particles.

12. A fusing apparatus according to claim 9 wherein said third charging means is an A.C. corona device for applying a charge on said fuser roll sufficient to neutralize any charge on the roll.

* * * * *